United States Patent [19]

Nishimoto

[11] Patent Number: 4,767,114

[45] Date of Patent: Aug. 30, 1988

[54] SHEET FEEDER

[75] Inventor: Kiyoshi Nishimoto, Oume, Japan

[73] Assignee: Kabushiki Kaisha Toshiba, Kawasaki, Japan

[21] Appl. No.: 890,279

[22] Filed: Jul. 29, 1986

[30] Foreign Application Priority Data

Jul. 30, 1985 [JP] Japan ..... 60-168026
Nov. 29, 1985 [JP] Japan ..... 60-268855

[51] Int. Cl.[4] ..... B65H 29/20

[52] U.S. Cl. ..... 271/3; 271/188; 271/209; 271/314; 101/348; 400/625

[58] Field of Search ..... 101/348; 271/314, 307, 271/188, 209, 3; 400/625

[56] References Cited

U.S. PATENT DOCUMENTS 3,791,644 2/1974 De Moore ..... 271/314

4,248,415 2/1981 Steinhilber ..... 400/625

*Primary Examiner*—Richard A. Schacher

*Attorney, Agent, or Firm*—Foley & Lardner, Schwartz, Jeffery, Schwaab, Mack, Blumenthal & Evans

[57] ABSTRACT

A sheet feeder having a slip preventing mechanism having a deformable member whose tip projects from a drive discharge roller by a short length and bends in contact with a sheet to be discharged in a small area, when the sheet is located between the drive discharge roller and the driven discharge roller. The deformable member transfers the sheets forcibly with biting them. As one of the drive roller and the driven roller which contacts the printed face of the sheet is made of a material which is hard to be stained by ink when contacted to the printed sheet, neither stain nor slip incur. Alternatively, the surface of one of the discharge rollers may be made rough.

9 Claims, 4 Drawing Sheets

SHEET FEEDER

BACKGROUND OF THE INVENTION

This invention relates to a printer and, more particularly, to a sheet feeder which supplies/discharges sheets of paper to be printed.

In a sheet feeder of a printer, sheets to be printed are taken out of a hopper by a feed roller, transferred through a sheet guide to a platen, printed by a print head on the platen, and then discharged.

The printed sheets are inserted between a drive roller having a rubber surface and being fixed to a drive shaft and a driven roller having a rubber surface, and then the sheets are discharged as the rollers rotate.

However, there is a problem that the rubber rollers tend to deteriorate the printing quality, because the rubber material soaks non-dried ink immediately after the printing and the soaked ink is transferred to the sheet, thus incurring stains on the sheets.

In order to solve this problem, a sheet feeder having metal drive and driven rollers has been proposed.

Although these metal rollers are indeed hardly stained with ink, they involve new problems of slip of sheets and instable discharging operation.

SUMMARY OF THE INVENTION

It is therefore an object of the present invention to provide a sheet feeder which does not bring the ink stains.

It is another object of the invention to provide a sheet feeder which enables to feed sheets stably.

The foregoing objects are accomplished by providing a sheet feeder comprising a sheet supply section; a feed roller; a pair of a drive roller and a driven roller which seize the sheets therebetween, at least one of which contacts the printed face of the sheet being made of a material which is hard to be stained with ink when contacted to a printed sheet; a slip preventing means having a base means whose diameter is smaller than that of the drive roller and having a deformable means whose tip projects from the drive roller surface by a short length and bends in contact with the sheet in a small area when the sheet is located between the drive roller and the driven roller; and a sheet discharge section, whereby the deformable means transfers the sheet forcibly with equibrating the bend of the sheet.

The foregoing object is also accomplished in another embodiment by providing a rough faced roller which contacts a printed face of the sheets and has properties of being hard to be stained and of having a friction coefficient sufficient for transferring sheets without slipping.

DESCRIPTION OF THE PREFERRED EMBODIMENT

Figure 1:
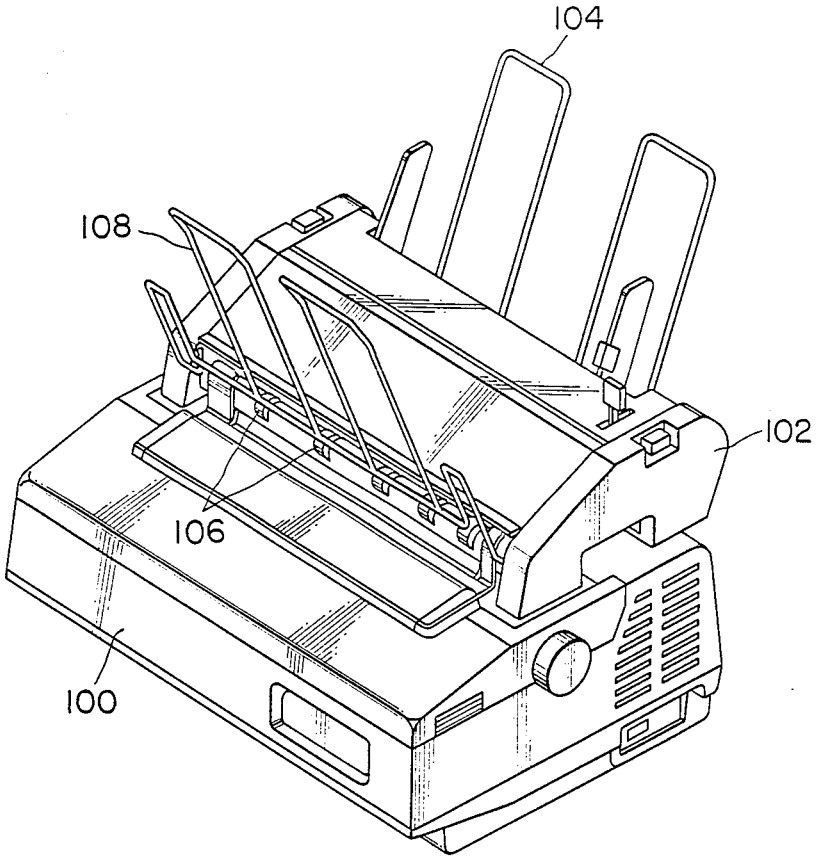
FIG. 1 is a perspective view of a printer to which the invention is applicable.

FIG. 1 shows an external view of a typical printer having a sheet feeder.

Referring to FIG. 1, a sheet feeder 102 is mounted on the printer body. In the sheet feeder, each of the sheets accumulated in a hopper 104 is drawn out by supply rollers (not shown) and sent to the printer. After printing, the printed sheet is discharged by discharging rollers 106 according to the invention and accumulated in the printed sheet stacker 108.

Figure 2:
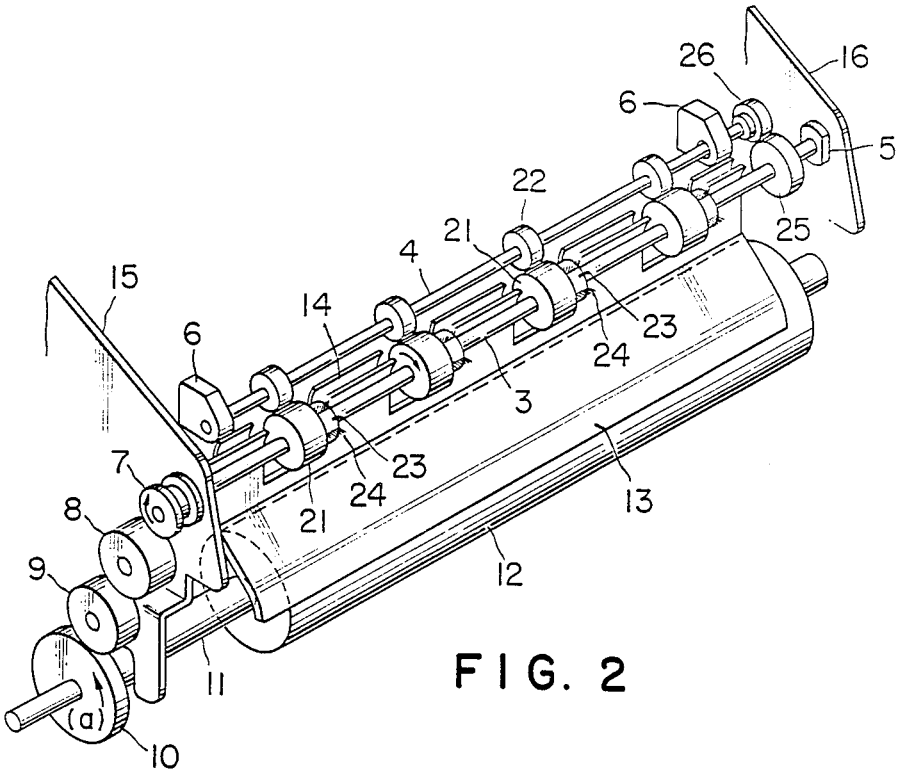
FIG. 2 is a perspective view of the major part of a sheet feeder according to an embodiment of the invention.
Figure 3:
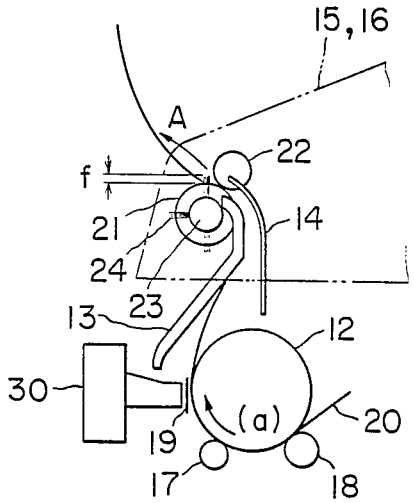
FIG. 3 is a cross sectional view along the center line of FIG. 2.

FIG. 2 shows the main part of the sheet feeder according to the invention and FIG. 3 shows a cross sectional view of the center part thereof.

Referring to the sheet feeder, the drive gear 7 engages with a platen gear 10 secured to a platen shaft 11 through idle gears 9 and 8. When the platen shaft 11 rotates, the drive gear 7 results in rotation, and a drive discharge roller 21 on the drive shaft 3, which is secured to the drive gear 7, rotates. In this embodiment, the number of the drive rollers 21 is four, and four driven discharge rollers 22 secured to a common driven shaft 4 contact the drive rollers 21, respectively. The driven roller 22 is made of rubber or material coated with rubber, and the driven shaft 4 is supported by bearings 6 free to rotate at both ends of the shaft 4. Bushes 5 for supporting the drive shaft are secured to a frame 14 and the driven gears 7, idle gears 8 and 9 are supported to the frame 14 in a manner of rotation free. Above the platen 12, a pair of sheet guides 13 and 14 which lead printed sheet to the entrance side of the drive roller 21, are provided.

The drive discharge roller 21 is made of metal with a smoothly finished surface. The metal roller, has an advantage of being hard to be stained with ink. But the friction coefficient is so small that the sheet will slip if the driven roller 22 is made to simply contact the drive roller 21. To solve this problem, the driven rollers 22 are forcibly synchronized with the drive rollers 21 by means of transmission gears 25 and 26 secured to the drive shaft 3 and driven shaft 4, respectively.

A roller 23 having a smaller diameter than the drive roller 21 is secured to the drive shaft 3 in the neibourhood of the drive roller 21. On the outer surface of the smaller roller 23, bristles 24 such as nylon bristles are set with the tips of bristles being projected from the outer diameter of the drive roller 21 by a short length f, as shown in FIG. 3.

Figure 4:
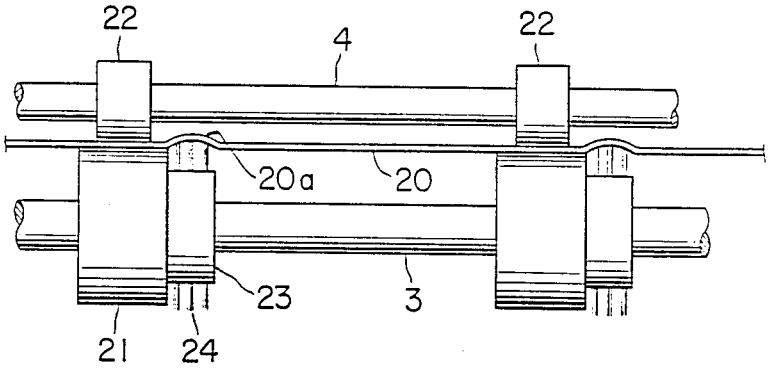
FIG. 4 shows relations among a drive roller, a driven roller, and a secured bristle part during printing operation.
Figure 5:
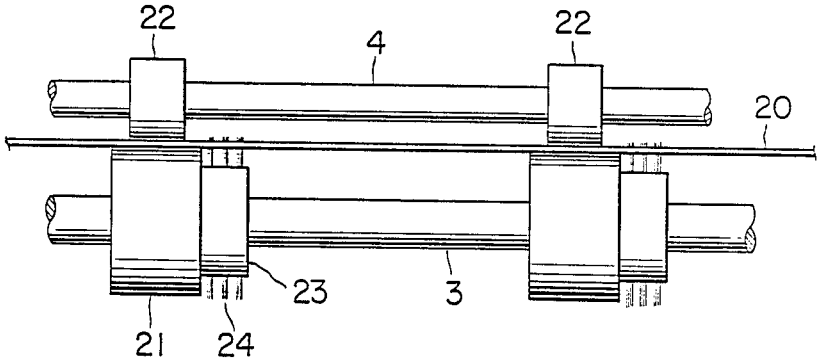
FIG. 5 shows relations among the drive roller, driven roller and the secured bristle part after discharging the sheet.

FIGS. 4 and 5 show the shape and the function of the bristles 24 of the roller 23 according to an embodiment. In this embodiment, bundles of at least three bristles each of which has, for example a diameter of 0.1 mm, are planted on the outer cylindrical surface of the roller 23 linearly along the axis of the shaft, and at four portions at every 90° thereon.

When the sheet 20 to be discharged is supported between the drive roller 21 and the driven roller 22, as shown in FIG. 4, the bristles which are in contact with the sheet bend, and these bends of bristles are equilibrated with the bend of the sheet 20. When this equilibrium occurs, the tips of bristles bite the sheet 20. This brings a slipless transfer of the sheet 20 at the time of rotation of the drive shaft.

After discharging the sheet 20, the bent tips of the nylon bristles return to the former state, and as shown in FIG. 5, the tips of the bristles project out of the sheet 20.

The operation of the sheet feeder according to the invention will now be described hereinbelow.

The sheet 20 transferred by a pair of friction rollers 17 and 18 and wound around the platen 12, is subjected to impact by a print head 30 with an ink ribbon 19 between the print head 30 and the sheet 20.

The printed sheet 20 is guided by paper guides 13 and 14, and then discharged to A direction caught by the drive discharge roller 21 and the driven discharge roller 22 which rotates in contact with the drive roller 21. The drive roller 21 is driven by a platen gear 10 which rotates in (a) direction and which is secured to the platen shaft 11, and by idle gears 8 and 9 and a drive gear 7. During this discharging, the drive discharge roller with a smooth surface and the slip protecting means allows the sheet 20 to be discharged without ink stains and slips.

Figure 6:
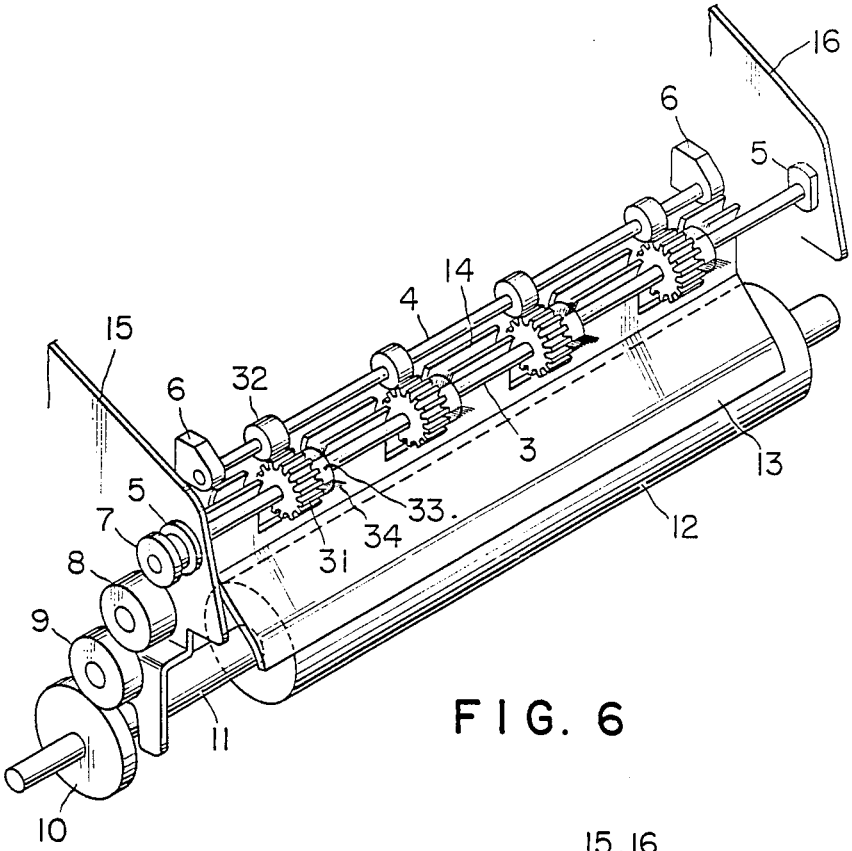
FIG. 6 is a perspective view of the major part of a sheet feeder according to another embodiment of the invention.
Figure 7:
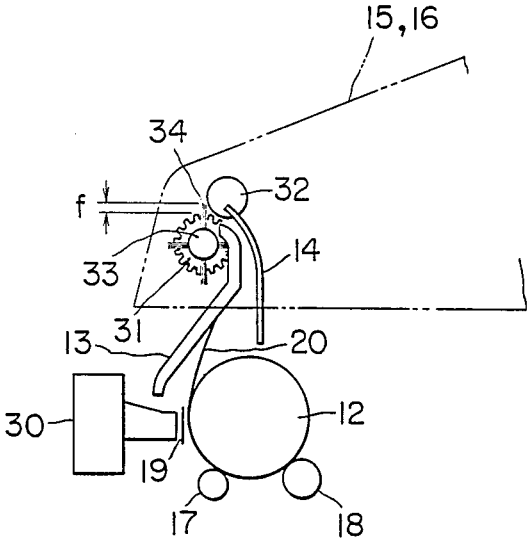
FIG. 7 is a cross sectional view of FIG. 6.

FIGS. 6 and 7 are a perspective view and a cross sectional view showing another embodiment of the invention, respectively. In FIGS. 6 and 7 different from FIGS. 2 and 3, a knurled metal drive roller 31 is used. The driven roller 32, small roller 33 and bristle section 34 correspond to the driven roller 22, small roller 23 and the bristle section 24, respectively and they have the same configurations and functions.

In this embodiment, the drive roller 31 is made of metal with knurling, so that the ink stain and slip of sheet are hardly generated.

In the above-mentioned embodiment, metal rollers are used as the drive roller. However, any material which is hard to be stained with ink, for example, synthetic resin such as polytetrafluoroethylene (Teflon), can be used.

Though the ink stain will be extremely decreased if the metal rollers are used, some staining is unavoidable in the long-term operation. In order to solve this problem, cleaning may be introduced by using a cleaning pad which is made of felt plate, etc.

Further, in the above-mentioned embodiments, a small roller having bristles is used. But any type of slip protecting means which enables sheets forcibly to be transferred in contact therewith in very small area, may be employed.

Figure 8:
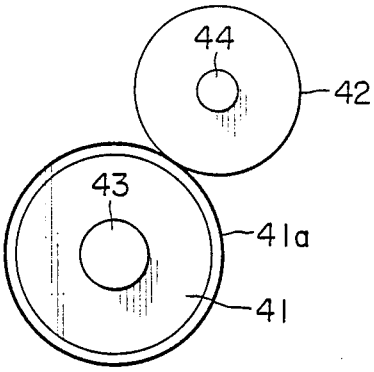
FIG. 8 shows a drive roller and a driven roller used in the sheet feeder according to an embodiment of the invention.
Figure 9:
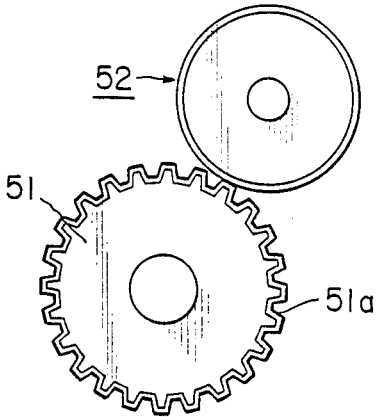
FIG. 9 shows another embodiment of drive/driven rollers.

FIGS. 8 and 9 show cross-sectional views, along the plane perpendicular to the drive shaft, of other embodiments according to another aspect of the invention.

In FIG. 8, there are employed a cylindrical drive roller 41 and a cylindrical driven roller 42 which contact with each other in the outer surfaces, and both rollers rotate with their shafts which are in parallel. On the surface of the drive roller 41, there is formed a flame coated thin metal film 41*a* of 50 μm or less, preferably 35~40 μm. Generally, a tungsten film is used but any metal film can be used if it is adapted for uniform coating and the flame coated film has a certain abrasion resistance.

Formation of the flame coated metal film is performed by utilizing a plasma coating of tungsten powder having an average grain size of not more than 50 μm, with rotation of the roller to obtain a uniform film thickness around the circumference.

According to the microscopic view of the flame coated surface, there are formed many fine projections. It is typical that the surface of the film has a roughness in which the average distance between adjacent tops is approximately 50 μm, because the surface of the roller can have proper friction against the sheet and have a property of being hard to be stained with ink when the printed sheet surface contacts.

In detail, there are observed micro-projections and depressions microscopically on the rough surface such as flame coated surface, so that the contact area between the sheet and the rough surface is very small and does not absorb ink, thus resulting in no transferring of ink and no deterioration of print quality. Besides, the friction coefficient of the surface is fairly large because of the above-mentioned micro-projections and depressions, and therefore reliable sheet discharge is possible without using the slip preventing means having bristles which may cause creases.

FIG. 9 also shows the combination of a drive roller 51 and a driven roller 52. In FIG. 9 different from FIG. 8, the surface of the drive roller 51 is knurled and the flame coated film 51*a* is formed thereupon. In this case, the combination of knurling and flame coating makes it possible to discharge sheets more smoothly.

The rough surface described above can be obtained by various methods other than flame coating. For example, sticking of small particles on a surface or roughing of the surface by shot blasting, may be employed.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A sheet feeder comprising:

a hopper where sheets to be supplied are stacked;

a feed roller which takes the sheets out of said hopper and transfers them between a print head and a platen;

a pair of a drive roller and a driven roller which rotate in opposite directions and seize the sheets therebetween, at least one of which contacts the printed face of the sheet being made of a material which is hard to be stained by ink when contacted to a printed sheet;

slip preventing means located adjacent the drive roller; and a stacker which stacks printed sheets, said slip preventing means comprising base means having a diameter which is smaller than that of said drive roller, and deformable means comprising tips projecting from the surface of said drive roller by a short length and bendable in contact with the sheet in a small area, when the sheet is located between said drive roller and said driven roller, whereby said deformable means transfers the sheet forcibly.

2. A sheet feeder according to claim 1, said deformable means includes a plurality of bundles of bristles set in the base means.

3. A sheet feeder according to claim 2, wherein said deformable bristles are arranged lineary along the axis of shaft.

4. A sheet feeder according to claim 3, wherein said bristles are formed into bundles.

5. A sheet feeder according to claim 2, wherein said drive roller is a metal roller with smoothly finished surface.

6. A sheet feeder according to claim 2, wherein said drive roller is a synthetic resin roller with smoothly finished surface.

7. A sheet feeder according to claim 5, wherein said drive roller has a knurled surface.

8. A sheet feeder comprising:

a hopper where sheets to be supplied are stacked;

a feed roller which takes the sheets out of said hopper and which transfers them between a print head and a platen;

a pair of a drive roller and a driven roller which rotate in opposite directions and seize the sheets therebetween; and a stacker which stacks printed sheets, at least one of the drive roller and the driven roller which contacts the printed face of the sheet having a rough surface which is hard to be stained with ink and has a friction coefficient sufficient for transferring sheets without slipping, and said drive roller accompanying slip preventing means comprising base means having a diameter of which is smaller than that of said drive roller, and deformable means comprising tips projecting from the surface of said drive roller, whereby said deformable means transfers the sheet forcibly.

9. A sheet feeder according to claim 8, wherein said deformable means includes a plurality of bundles of bristles set in the base means.

* * * * *